United States Patent [19]

Ragailler

[11] 4,436,160

[45] Mar. 13, 1984

[54] SPRAYER

[76] Inventor: Franz Ragailler, Schmiedstrasse 6, A-4070 Eferding Österreich, Austria

[21] Appl. No.: 341,293

[22] Filed: Jan. 21, 1982

[51] Int. Cl.[3] ..... A62C 31/02; B05B 1/32

[52] U.S. Cl. ..... 169/74; 169/85; 239/454

[58] Field of Search ..... 169/30, 56, 71, 74, 169/85, 89, 26; 239/453, 454, 506, DIG. 1

[56] References Cited

U.S. PATENT DOCUMENTS

| | | | |
|---|---|---|---|
| 699,801 | 5/1902 | Martin | 239/506 |
| 1,815,494 | 7/1931 | Camp | 169/85 |
| 2,543,996 | 3/1951 | Turner | 239/453 |
| 2,550,100 | 4/1951 | Voss | 239/453 |
| 2,559,634 | 7/1951 | Keefe, Jr. et al. | 169/85 |
| 2,764,246 | 9/1956 | Emmrich et al. | 169/74 |
| 2,819,764 | 1/1958 | Anthony, Jr. | 169/85 |
| 3,485,365 | 12/1969 | Keller | 239/453 |
| 3,779,318 | 12/1973 | Livingston . | |
| 3,783,947 | 1/1974 | Dix et al. . | |
| 3,823,779 | 7/1974 | Stamm et al. . | |
| 4,069,873 | 1/1978 | McClure | 169/56 |

*Primary Examiner*—John J. Love
*Assistant Examiner*—Jon Rastello
*Attorney, Agent, or Firm*—Kurt Kelman

[57] ABSTRACT

A sprayer spraying liquid or pulverulent substances, particularly fire-extinguishing or fire-inhibiting substances, comprises a tank adapted to hold the substance to be sprayed, a sprayhead, a rising pipe extending from said tank to said sprayhead, and a pressure vessel, which contains a gaseous fluid and communicates through a shutoff valve with the tank. In order to ensure that the sprayed substance will be uniformly spread over a large area, the sprayhead is composed of a base, which is coaxially connected to the rising pipe and flares preferably like a cup, and a coverlike top, which is adapted to be tightly seated on said base and is adapted to be lifted from said base as far as to a stop, which can be adjusted in height, said top is adapted to be raised against a bias which is due to gravity and/or spring means, and an annular gap is held open between the base and the raised top by the substance as it is expelled in response to an actuation, preferably a sensor-controlled automatic actuation, of the shutoff valve connected between the pressure vessel and the tank.

16 Claims, 3 Drawing Figures

Figure 1:
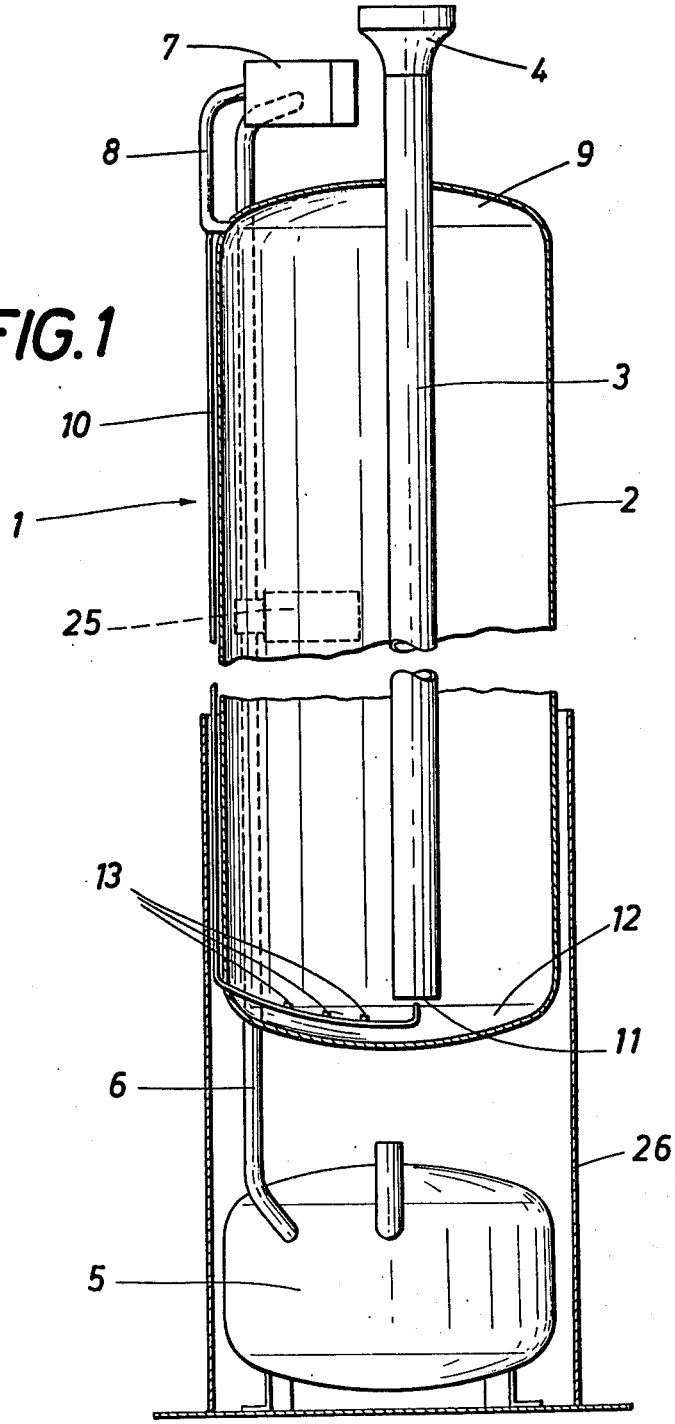

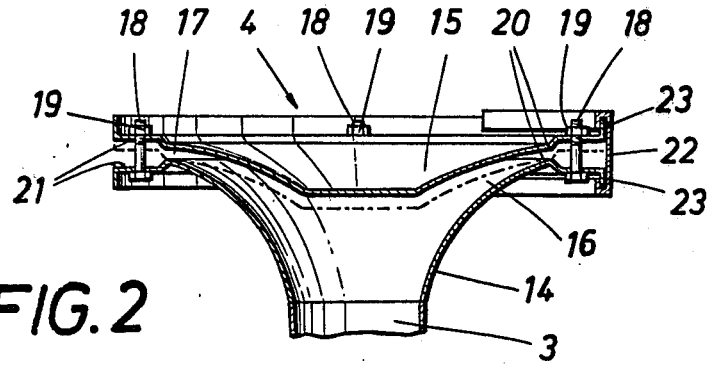
FIG. 2
FIG. 3
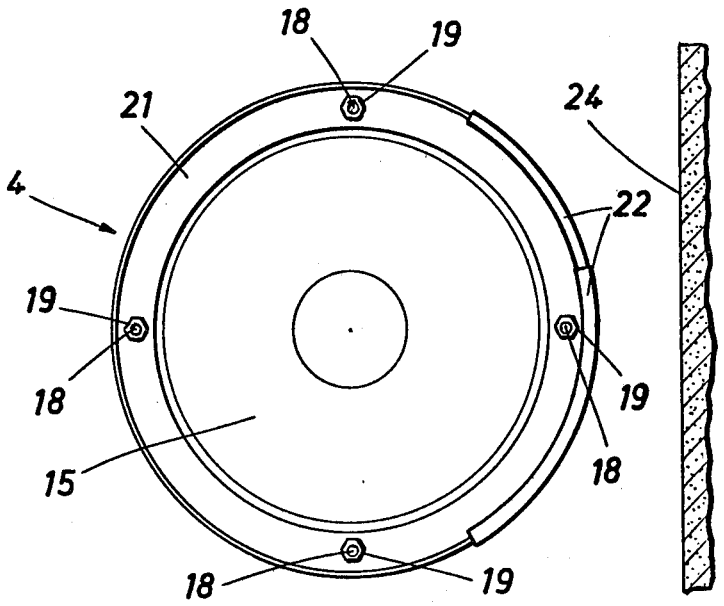

SPRAYER

This invention relates to a sprayer for spraying liquid or pulverulent substances, particularly fire-extinguishing or fire-inhibiting substances, comprising a tank adapted to hold the substance to be sprayed, a sprayhead, a rising pipe extending from said tank to said sprayhead, and a pressure vessel, which contains a gaseous fluid and communicates through a shutoff valve with the tank.

Such sprayers are used mainly as fire extinguishers and their operation is initiated in that the conduit connecting the pressure vessel to the tank is opened because the compressed gas, such as compressed air, can then flow into the tank and can force the substance contained in the tank through the rising pipe to the sprayhead, from which the substance is sprayed in dependence on the pressure applied and on the shape of the sprayhead. The sprayheads used thus far have comprised various orifice plates, all of which can spread the emerging jet only to a restricted extent and require that the jet be directed to the source of the fire. For this reason such fire extinguishers must be manually operated in practice and cannot be used as automatic fire extinguishers or for protection from fire.

Virtually all automatic fire-entinguishing installations which now exist constitute so-called sprinkler installations, which consist of pressure water pipes installed above the ceilings of rooms which are endangered by fire, and spaced apart sprayheads, which are similar to shower heads and connected to said pipes. These sprayheads have a sealing cover, which is released to fall down when a fusible element has fused at a certain elevated temperature so that the fire-extinguishing water can then emerge from the sprayhead. In such installations, the sprayheads and the other parts which are fixedly installed in a building involve a high structural expenditure, besides, these installations cannot be used to prevent a fire and their fire-extinguishing effect remains rather small as the fire-extinguishing water is distributed by the sprayheads as by shower heads.

It is an object of the invention to eliminate these disadvantages and to provide a sprayer which is of the kind described first hereinbefore and while being simple in structure ensures that the substances to be sprayed will be spread over a large area and which can be automatically operated for preventing and extinguishing fires without need for installations fixed in a building.

This object is accomplished according to the invention in that the sprayhead is composed of a base, which is coaxially connected to the rising pipe and flares preferably like a cup, and a coverlike top, which is adapted to be tightly seated on said base and is adapted to be lifted from said base as far as to a stop, which can be adjusted in height, said top is adapted to be raised against a bias which is due to gravity and/or spring means, and an annular gap is held open between the base and the raised top by the substance as it is expelled in response to an actuation, preferably a sensor-controlled automatic actuation, of the shutoff valve connected between the pressure vessel and the tank. That sprayhead having a top which is urged against the base by the weight of the top or by an additional weight or by a spring bias provides for a self-regulating spreading of the substance which is supplied through the rising pipe and which under the pressure applied raises the top so that the previously closed annular gap between the top and base is opened and the substance is sprayed as a fan jet extending throughout the periphery of the gap. Before and after the spraying operation the sprayhead and particularly its top constitutes a simple, tight closure for the tank. The spraying rate can be controlled by the stop, which is adjustable in height and determines the area of the annular gap. Different from orifices, that annular gap cannot become clogged and can be adjusted without difficulty by a proper positioning of the stop. As the substance contained in the tank can be spread over large areas by means of this sprayhead within very short time, such sprayer is particularly suitable for extinguishing and inhibiting a fire. If the shutoff valve between the pressure vessel and the tank is adapted to be automatically actuated, e.g., by a sensor which is responsive to light or heat, the appliance will constitute an automatic fire-inhibiting and extinguishing system as the substance stored in the tank will be rapidly sprayed in response to the opening of the shutoff valve. The substance may consist of a fire-extinguishing or fire-inhibiting substance, as desired. Whereas the entire sprayer operates automatically and has a large range of action, it is independent of any installation that is fixed to a housing. For this reason the sprayer can be used anywhere and at any time.

A simple structure will be obtained if the sprayhead has a preferably flaring rim, which is disposed radially outwardly of the seating faces of the top and base, and screws, which are parallel to the axis of the sprayhead, extend through said rim and serve to guide the top and carry nuts as stops for the top. These screws may be fixed by welding, e.g., in the base and with their free end portion may extend through fitting holes in the top and ensure in a simple manner that the top will be guided along a straight line as it is raised. The nuts constitute stops, which can easily be adjusted in an exact manner. Because the screws are disposed outside the seating area, they do not interrupt or adversely affect the tightness of the seal when the top is seated on the base.

According to a particularly preferred feature of the invention the sprayhead comprises an adjustable shutter, which extends around the periphery of the annular gap and serves to limit the same, which shutter may consist, e.g., of an arcuate bar, which is slidably fitted on peripheral edge flanges of the top and base. Whereas without such shutter the fan jet would emerge throughout the periphery of the annular gap, the shutter can be used to cover certain parts of said gap so that the spraying of the substance can be restricted to a certain sector. The shutter may consist of a single bar, which is slidable along the rim and restricts the spraying angle as desired. The bar may consist of two or more parts so that different angular ranges can be covered or opened as desired.

Within the scope of the invention it will be particularly desirable to provide two supply ducts which extend between the pressure vessel and the interior of the tank, one of which ducts constitutes a pressurizing duct opening near the top of the tank, and the other of said ducts constitutes an atomizing duct which opens near the inlet opening of the rising pipe. When pressure is applied to the top portion of the tank in order to expel the substance which is stored, pressure fluid will be forced at the same time virtually directly into the rising pipe so that an injector action will be produced and will cause air or gas to fluidize the substance which is forced outwardly through the rising pipe. As a result, an air-substance mixture will pass through the sprayhead.

That injector action increases also the velocity at which the substance is ejected so that the sprayed jet has a larger range. The fire-extinguishing or fire-inhibiting substance is subjected to an atomizing action which is strong enough to disperse the substance in three dimensions but cannot reduce the substance to a very fine mist because in that form the substance would be ineffective and much too susceptible to air currents. Because the pressure fluid from the pressure vessel is used to entrain and atomize the substance to be sprayed, the substance as it is sprayed is uniformly spread throughout the room. As a result, the sprayer constitutes an optimum fire extinguisher, which in response to the initiation of its operation immediately fills the entire room with the substance, which covers all surfaces and effectively prevents their inflammation.

It will also be desirable to provide the atomizing duct with additional outlet openings near the bottom of the tank so that the pressure fluid emerging also near the bottom of the tank will agitate the contents of the tank near the inlet of the rising pipe and will prepare them for their atomization. Above all, this will ensure that any component of the fire-extinguishing or fire-inhibiting substance which may have settled will be entrained and no remainders will be left in the tank.

In accordance with a desirable further development of the invention, the flow area of the atomizing duct is smaller than the flow area of the pressurizing duct and both ducts are preferably connected to a common discharge duct, which extends from the pressure vessel and incorporates the shutoff valve. As a major portion of the pressure fluid stored in the pressure vessel is required for ejecting the substance to be sprayed from the tank and a minor portion is sufficient for atomizing, the use of ducts differing in size will ensure with a minimum expenditure that the pressure fluid which is available will be divided as desired. A further simplification is provided by the common discharge duct because only a single shutoff valve will be required and pressure fluid will be supplied to the pressurizing duct and the atomizing duct at the same time whenever the sprayer is operated.

In accordance with a most desirable further feature of the invention the pressure vessel and the tank, on the one hand, and the pressure fluid and the substance to be sprayed, on the other hand, are so matched that the range of the spray jet decreases continuously as the substance is sprayed so that the area on which the substance can be sprayed will be as large as possible. This result will be obtained automatically without need for any control action if the ratio of the superatmospheric pressure in the pressure vessel to the ambient pressure is about the same as the ratio of the volumetric capacity of the tank to the volumetric capacity of the pressure vessel. When such a pressure vessel is connected to the tank through a sensor-controlled shutoff valve and if that valve opens the communication between the pressure vessel and the tank at the proper time, then a fan-like or umbrellalike jet will be sprayed and its range will uniformly decrease from an initial maximum so that the substance sprayed from the tank will be spread over a large area in an approximately uniform quantity per unit of area. Such a sprayer will be particularly suitable for protection against a fire because it can spray at a time of danger a fire-inhibiting substance which will prevent a spreading of the fire. It will be understood that such a sprayer can be placed at any desired locations and at any time and in any desired number so that a perfectly operative fire-extinguishing and fire-inhibiting system which is independent of existing installations can be provided at any time.

A sprayer which is handy and can easily be positioned will be obtained if, in accordance with a preferred further feature of the invention, the tank and the pressure vessel are arranged one over the other in a common shell. Such a unit can easily be positioned anywhere or can be incorporated in a wall. It will be understood that the sprayhead may be mounted directly on the tank or may be mounted at another suitable location and connected to the tank by the properly extended rising pipe; this will depend on individual conditions.

An embodiment of the invention is shown strictly diagrammatically and by way of example on the accompanying drawing, in which FIG. 1 is a vertical sectional view showing a sprayer which embodies the invention.

FIGS. 2 and 3 are a sectional view and a top plan view, respectively, which show on a larger scale an embodiment of a sprayhead which can be used in that sprayer.

The sprayer 1 is used as an automatic fire extinguisher and comprises a tank 2, which contains a fire-extinguishing and fire-inhibiting substance and which is provided with a rising pipe 3 and a sprayhead 4 mounted on said pipe. Compressed air or another compressed gas from a pressure vessel 5 is used to expel the fire-extinguishing or fire-inhibiting substance from the tank 2. Two supply ducts leading into the tank 2 are connected to the pressure vessel 5 by an automatically controlled shutoff valve 7 and a common discharge duct 6. The supply ducts consist of a pressurizing duct 8, which is larger in cross-section and opens near the top 9 of the tank 2, and an atomizing duct 10, which is smaller in cross-section and opens near the inlet opening 11 of the rising pipe. The atomizing duct 10 has outlet openings 13 also close to the bottom 12 of the tank 2.

It is apparent from FIGS. 2 and 3 that the sprayhead 4 comprises a base 14, which flares like a cup and is connected to the rising pipe 3, and a top 15, which is adapted to be tightly seated on said base. The top 15 and base 14 define between them a tapering passage 16, which effects a centrally symmetrical distribution and a deflection of the substance to be sprayed. When the tank is not pressurized, the top 15 is tightly seated on the base 14, as is shown in dotted lines in FIG. 2. If pressure is applied to the tank in order to expel its contents, the top 15 will be lifted from the base 14 and an annular gap 17 will be opened, which constitutes an approximately horizontal flow path from the passage 16 into the open. The substance which has been forced from the rising pipe 3 into the sprayhead 4 is thus sprayed as a uniform jet, which extends around the periphery and resembles an umbrella. To permit a control of the height of the gap, an adjustable stop is associated with the liftable top 15 and consists of screws 18 and nuts 19 screwed on said screws. The screws 18 are fixed in the base 14 and protrude through openings of the top 15 so that they serve also as means for vertically guiding the top 15 as it is raised. To ensure that there will be no leaks in the sprayhead 4 at these screws 18, the latter are disposed radially outwardly of the seating surfaces 20 of the top 15 and base 14. The rims 21 of the top 15 and base 14 outside the seating area define a flaring passage between them so that the jet which is being sprayed through the annular gap 17 can flow without obstruction.

To permit a restriction of the peripheral extent of the annular gap 17 and of the resulting jet which resembles an umbrella when such restriction is desired, a shutter bar 22 is provided, which is slidably mounted on peripheral annular edge flanges 23 of the base 14 and top 15. That bar 22 may consist of two parts and can be used to cover an angular range which is not to be reached by the jet which is sprayed. This may be necessary if the sprayer has been placed on a wall 24, as is indicated in FIG. 3.

When the sprayer 1 is started by the automatic control of the shutoff valve 7, e.g., in dependence on the ambient temperature, or by the manual opening of a valve 25 which is incorporated in the discharge duct 6, the communication between the pressure vessel 5 and the interior of the tank 2 will be opened and compressed air will flow through the pressurizing duct 8 and the atomizing duct 10 into the region 9 near the top of the tank 2 and into the region 12 near the bottom of the tank so that the fire-extinguishing and fire-inhibiting substance contained in the tank 2 will be agitated near the bottom and together with any components which may have settled will be forced in the rising pipe 3 to the sprayhead 4 and as it flows in the rising pipeline will be fluidized and mixed with air. The resulting mixture of air and fire-extinguishing substance is uniformly distributed by the sprayhead 4. Because the fire-extinguishing and fire-inhibiting substance is atomized, it is spread in space. In order to cover a large range also in a radial direction and to spray the substance on the largest possible area, the pressure in the pressure vessel 5 and the volumetric capacity of the pressure vessel 5 and the volumetric capacity of the tank 2 may be selected so that the range of the umbrellalike jet decreases continuously to zero from an initial maximum size. This will be accomplished, e.g., if the ratio of the superatomospheric pressure in the pressure vessel 5 to the ambient pressure equals the ratio of the volumetric capacity of the tank 2 to the volumetric capacity of the pressure vessel 5.

As is indicated in FIG. 1 the tank 2 and the pressure vessel 5 may be arranged one over the other and may have a common shell 26 so that the sprayer 1 constitutes a unit which can be placed simply on the floor without need for stationary additional means. Because the tank and the pressure vessel can be refilled without difficulty, the sprayer can be used very often. The sprayer according to the invention distinguishes in that it can uniformly distribute large quantities of liquids or powders over large areas within a short time in response to a manual or automatic opening of the corresponding shutoff valve. For this reason the sprayer is particularly suitable for protection from fire.

What is claimed is:

1. In a sprayer comprising a tank adapted to hold a sprayable substance, a sprayhead disposed above said tank, a rising pipe having an inlet opening in the lower portion of the interior of said tank and leading to said sprayhead, a pressure vessel adapted to hold a compressed gas, and a shutoff valve operable to establish a communication between the interior of said pressure vessel and the interior of said tank, the improvement residing in that said sprayhead comprises a base and a top, said base is coaxial to and communicates with said rising pipe and flares upwardly and has an upwardly facing, annular seating face, said top is exposed on its underside to the interior of said base and is vertically movable relative to said base and biased to a lower position and has an annular seating face which faces the seating face of said base and is arranged to be in sealing contact with said seating face of said base when said top is in said lower position, said base and said top have portions which extend radially outwardly of said seating surfaces and face each other, said radially outwardly extending portions of said top are formed with angularly spaced apart holes, said radially outwardly extending portions of said base and said top are vertically spaced apart when said top is in said lower position, said top is adapted to be raised so that said seating faces of said base and said top define between them an annular gap in response to fluid pressure in the interior of said base, screws which are parallel to the axis of said sprayhead are secured to said radially outwardly extending portions of said base and extend upwardly from said base through said holes and above said top, and said base carries vertically adjustable stop means, which are spaced above said top when the same is in said lower position and adapted to be engaged by said top to the limit the upward movement thereof, said stop means consisting of nuts screwed on said screws above said top.

2. The improvement set forth in claim 1, wherein said tank contains a liquid.

3. The improvement set forth in claim 1, wherein said tank contains a powder.

4. The improvement set forth in claim 1, wherein said tank contains a fire-extinguishing, sprayable substance.

5. The improvement set forth in claim 1, wherein said tank contains a fire-inhibiting, sprayable substance.

6. The improvement set forth in claim 1, wherein said base is cup-shaped.

7. The improvement set forth in claim 1, wherein said top is biased toward said lower position by gravity.

8. The improvement set forth in claim 1, wherein said base and said top have respective rims which comprise said radially outwardly extending portions.

9. The improvement set forth in claim 1, wherein said sprayhead comprises annularly adjustable, arcuate shutter means, which extend along said annular gap and close the same in part of its peripheral extent.

10. The improvement set forth in claim 1, wherein said base and said top have respective peripheral edge flanges disposed radially outwardly of said seating faces and said shutter means comprise an arcuate bar, which is slidably fitted between said edge flanges.

11. The improvement set forth in claim 1, wherein the interior of said pressure vessel communicates with the interior of said tank through an atomizing duct and a pressurizing duct, said atomizing duct opens in said tank near the inlet opening of said rising pipe, and said pressurizing duct opens into said tank above said inlet opening.

12. The improvement set forth in claim 11, wherein said atomizing duct has outlet openings near the bottom of said tank.

13. The improvement set forth in claim 11, wherein the flow area of said atomizing duct is smaller than that of said pressurizing duct.

14. The improvement set forth in claim 13, wherein said pressurizing and atomizing ducts communicate with the interior of said pressure vessel through a common discharge duct, which incorporates said shutoff valve.

15. The improvement set forth in claim 1, wherein said pressure vessel contains a gas under a predetermined superatmospheric pressure and the ratio of said superatmospheric pressure to the ambient pressure is about as large as the volumetric capacity of said tank to the volumetric capacity of said pressure vessel.

16. The improvement set forth in claim 1, wherein said tank and said pressure vessel are disposed one over the other in a common shell.

* * * * *